US008359866B2

(12) United States Patent
Dierberger et al.

(10) Patent No.: US 8,359,866 B2
(45) **Date of Patent: *Jan. 29, 2013**

(54) COMBUSTOR LINER SEGMENT SEAL MEMBER

(75) Inventors: James A. Dierberger, Hebron, CT (US); Masamichi Hongoh, Manchester, CT (US); Dennis J. Sullivan, Vernon, CT (US)

(73) Assignee: United Technologies Corporation, Hartford, CT (US)

( * ) Notice: Subject to any disclaimer, the term of this patent is extended or adjusted under 35 U.S.C. 154(b) by 318 days.

This patent is subject to a terminal disclaimer.

(21) Appl. No.: 12/700,453

(22) Filed: Feb. 4, 2010

(65) Prior Publication Data

US 2011/0185737 A1 Aug. 4, 2011

(51) Int. Cl.
*F02C 1/00* (2006.01)

(52) U.S. Cl. ..... 60/752

(58) Field of Classification Search ..... 60/752–760, 60/796–800

See application file for complete search history.

(56) References Cited

U.S. PATENT DOCUMENTS

| | | | | |
|---|---|---|---|---|
| 2,686,655 | A * | 8/1954 | Schorner | 416/214 R |
| 2,702,987 | A * | 3/1955 | Nicolin | 60/799 |
| 4,302,941 | A | 12/1981 | DuBell | |
| 4,380,906 | A | 4/1983 | Dierberger | |
| 4,422,300 | A | 12/1983 | Dierberger et al. | |
| 4,655,044 | A | 4/1987 | Dierberger et al. | |
| 5,758,503 | A | 6/1998 | DuBell et al. | |
| 5,782,294 | A | 7/1998 | Froemming et al. | |
| 6,705,832 | B2 * | 3/2004 | Tiemann | 415/116 |
| 6,875,476 | B2 * | 4/2005 | Hawtin et al. | 427/448 |
| 7,363,763 | B2 | 4/2008 | Coughlan, III et al. | |
| 7,464,554 | B2 | 12/2008 | Cheung et al. | |
| 7,886,540 | B2 * | 2/2011 | Webb | 60/752 |
| 8,051,663 | B2 * | 11/2011 | Tuthill | 60/755 |
| 2003/0089115 | A1 * | 5/2003 | Gerendas | 60/796 |
| 2008/0113163 | A1 | 5/2008 | Schlichting et al. | |
| 2009/0101787 | A1 | 4/2009 | Dierberger | |
| 2009/0169368 | A1 | 7/2009 | Schlichting et al. | |
| 2010/0077764 | A1 * | 4/2010 | Dierberger | 60/754 |
| 2011/0185740 | A1 * | 8/2011 | Dierberger et al. | 60/755 |

* cited by examiner

*Primary Examiner* — Phutthiwat Wongwian

(74) *Attorney, Agent, or Firm* — O'Shea Getz P.C.

(57) ABSTRACT

A combustor liner segment seal member is provided that includes a center section, a forward flange, and an aft flange. The center section includes a base surface, a gas path surface, a forward side surface, and an aft side surface. The forward flange extends outwardly from the forward side surface, and includes a width, a height, a shell side surface, and a liner side surface. The aft flange extends outwardly from the aft side surface, and includes a width, a height, a shell side surface, and a liner side surface.

15 Claims, 3 Drawing Sheets

FIG.1
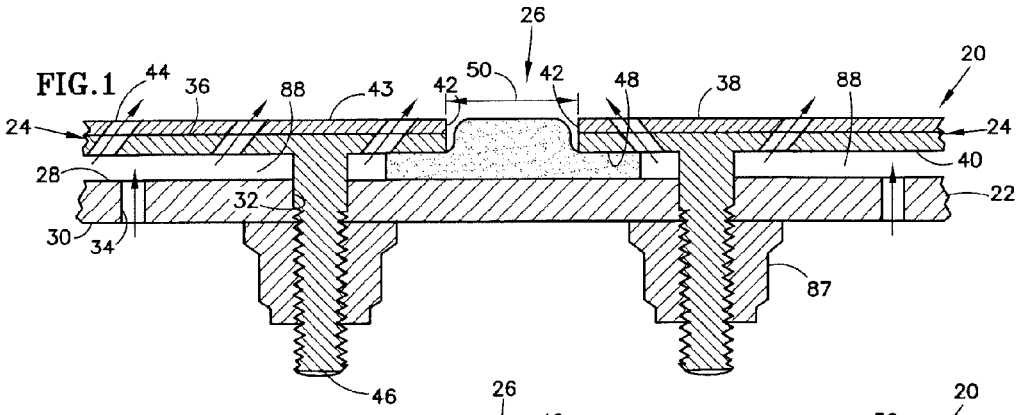
FIG.2
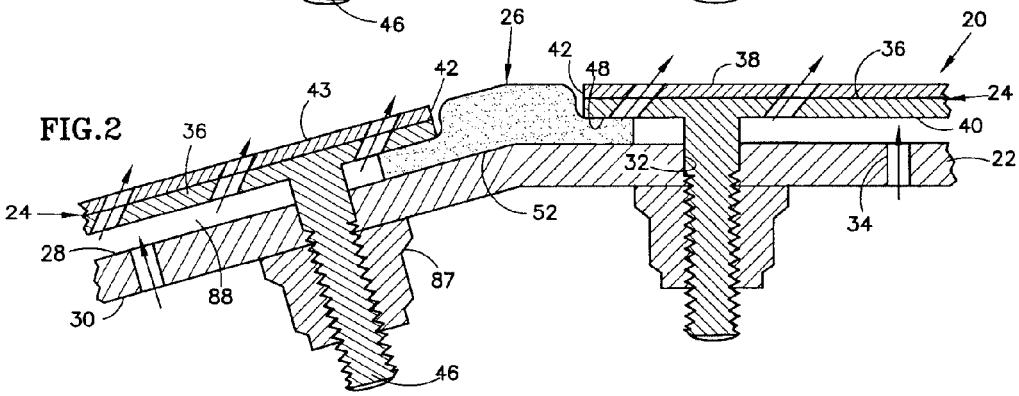
FIG.3
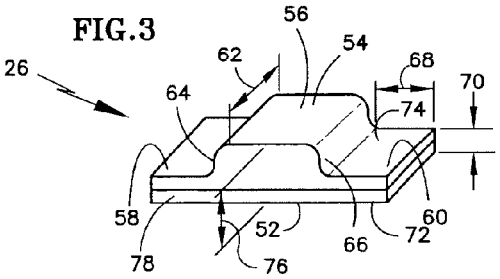
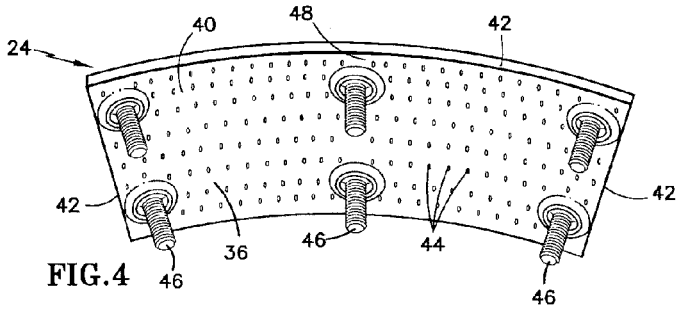
FIG.4

COMBUSTOR LINER SEGMENT SEAL MEMBER

BACKGROUND OF THE INVENTION

1. Technical Field

This disclosure relates generally to combustor walls for a gas turbine engine and, more particularly, to members for sealing between adjacent combustor liner segments.

2. Background Information

Typical combustors for a gas turbine engine are subject to high thermal loads for prolonged periods of time. These thermal loads can create significant thermal stresses in walls of the combustors. One method to alleviate thermal stress is to impinge cooling air against the back surface of combustor liner segments. The impingement cooling air enters the impingement cavities formed between the liner segments and the combustor shell through impingement holes disposed within the shell. The same cooling air is subsequently used to form film cooling on the exposed face of each liner segment. The cooling air passes through film cooling holes disposed in the liner segments (typically at an angle) to create a film of cooling air that both cools the segment surface and provides a insulating film that protects the liner surface.

In many instances, core gas flow path anomalies and hardware geometries create flow irregularities that lead to thermal hotspots where the increased temperature leads to accelerated thermal degradation. Gaps disposed between adjacent liner segments are particularly prone to thermal hotspots because of the local gas path patterns and inefficient cooling. These gaps typically extend from the core gas path exposed liner segment surfaces all the way to the surface of the combustor shell.

SUMMARY OF THE DISCLOSURE

According to an aspect of the invention, a combustor liner segment seal member is provided that includes a center section, a forward flange, and an aft flange. The center section includes a base surface, a gas path surface, a forward side surface, and an aft side surface. The forward flange extends outwardly from the forward side surface, and includes a width, a height, a shell side surface, and a liner side surface. The aft flange extends outwardly from the aft side surface, and includes a width, a height, a shell side surface, and a liner side surface.

According to another aspect of the present invention, a combustor for a gas turbine engine is provided that includes a support shell, a forward liner segment, an aft liner segment, and a seal member. The shell has an interior surface. The forward liner segment and aft liner segment are attached to the interior surface of the shell. The forward liner segment has an edge surface extending between a face surface and a back surface, and a seal shoulder. The aft liner segment has an edge surface extending between a face surface and a back surface, and a seal shoulder. The seal member has a center section, a forward flange, and an aft flange. The seal member is disposed in a gap between the forward liner segment and the aft liner segment. The forward flange is disposed between the seal shoulder of the forward liner and the interior surface of the shell, and the aft flange is disposed between the seal shoulder of the aft liner and the interior surface of the shell.

The foregoing features and the operation of the invention will become more apparent in light of the following description and the accompanying drawings.

BRIEF DESCRIPTION OF THE DRAWINGS

FIG. 1 is a cross-sectional diagrammatic illustration of a combustor that includes liners segments and a seal member attached to a shell.

FIG. 2 is a cross-sectional diagrammatic illustration of a combustor that includes liners segments and a seal member attached to a shell, wherein the seal member has an angled configuration.

FIG. 3 is a perspective diagrammatic illustration of the seal member shown in FIG. 1.

FIG. 4 is a perspective diagrammatic illustration of a liner segment.

DETAILED DESCRIPTION OF THE INVENTION

Figure 5:
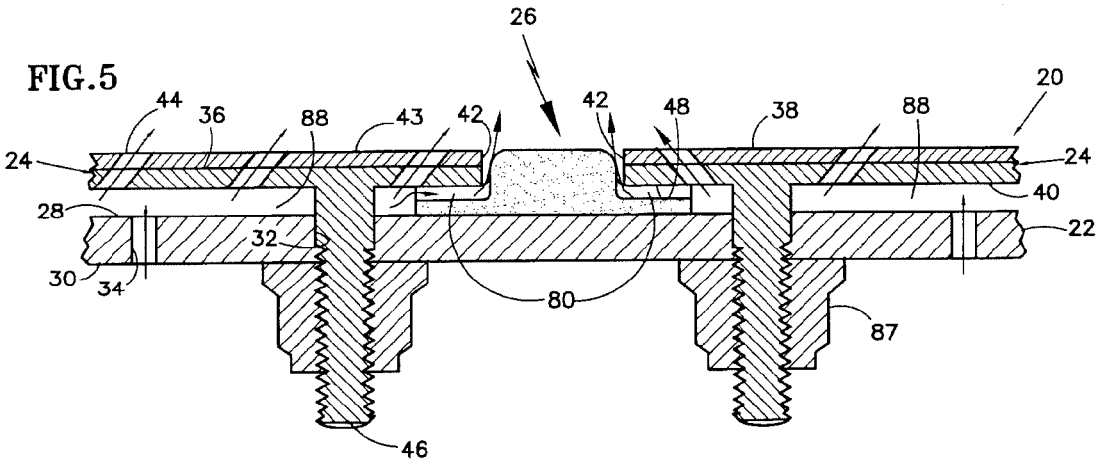
FIG. 5 is a cross-sectional diagrammatic illustration of a combustor that includes liner segments and a seal member embodiment.

Referring to FIGS. 1-4, a combustor 20 for a gas turbine engine includes a support shell 22, a plurality of liner segments 24, and one or more seal members 26. The support shell 22 shown in FIG. 1 is a cross-sectional partial view of an annular shaped support shell 22. The present invention is not limited to combustors of any particular shape. The support shell 22 includes an interior surface 28, an exterior surface 30, a plurality of liner segment mounting holes 32, and a plurality of impingement coolant holes 34 extending through the interior and exterior surfaces 28, 30.

Each liner segment 24 includes a panel 36 having a face surface 38, a back surface 40, and edge surfaces 42 extending between the face surface 38 and the back surface 40. The linear segment shown in FIGS. 1 and 2 includes a thermal barrier coating 43 applied to the face surface 38 of the segment. The thermal barrier coating 43 is not required for the present invention. A plurality of film coolant holes 44 extend through the panel 36 between the face surface 38 and the back surface 40. A plurality of mounting studs 46 extends outwardly from the back surface 40 of each liner segment 24. The mounting studs 46 are disposed inwardly from the edge surfaces 42. The portions of each panel 36 disposed outside of the mounting studs 46 (e.g., between the mounting studs 46 and the edge surfaces 42) are referred to as the seal shoulder 48. The size of the seal shoulders 48 and the positions of the mounting holes 32 positions within the support shell 22 are such that gaps 50 are formed between edge surfaces 42 of adjacent liner segments 24 when the segments are mounted on the combustor shell 22.

Each seal member 26 includes a base surface 52, a gas path surface 54, a center section 56, a forward flange 58, an aft flange 60, and a length 62. The center section 56 includes a forward side surface 64 and an aft side surface 66. The center section 56 has a height 76 that extends between the base surface 52 and the gas path surface 54. The forward flange 58 extends out from the forward side surface 64, and the aft flange 60 extends out from the aft side surface 66. Each flange 58, 60 has a width 68, a height 70, a shell side surface 72, and a liner side surface 74. In the embodiment shown in FIGS. 1-4, the flanges 58, 60 have equal widths 68 and heights 70. In alternative embodiments, the flange widths 68 and heights 70 may differ from one another. In some embodiments, the height 76 of the center section 56 is greater than the height 70 of the flanges 58, 60. The difference in heights 70, 76 between the center section 56 and the flanges 58, 60 is typically, but not necessarily, substantially equal to the thickness of a liner segment seal shoulder 48. In some applications, the seal members 26 are arranged lengthwise to form a circumferential seal that can extend a portion of the shell circumference, or can collectively extend the entire circumference of the shell 22. The length 62 shown in FIG. 3 is for illustrative purposes, and is not representative of all seal member lengths. The seal member 26 shown in FIG. 3 has a planar configuration to fit the configuration of the liner segments 24 shown in FIG. 1. The seal member 26 shown in FIG. 2 has an angled configuration to fit the liner segment 24 configuration shown in FIG. 2.

The seal member 26 is constructed from any suitable material capable of withstanding the thermal loads expected within the particular combustor 20 application at hand. Suitable materials include ceramic matrix composites ("CMCs"), super metal alloys, etc.

In some embodiments, a thermal barrier coating ("TBC") 78 is disposed on one or more of the base surface 52 of the center section 56, the shell side surface 72 of the forward flange 58, and the shell side surface 72 of the aft flange 60.

Figure 6:
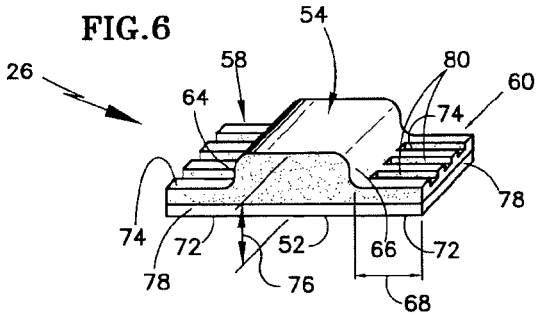
FIG. 6 is a perspective diagrammatic illustration of the seal member shown in FIG. 5.

In the embodiment shown in FIGS. 5 and 6, the seal members 26 are configured as described above and shown in FIGS. 1-4, and further include one or more cooling air slots 80 disposed in the liner side surface 74 of one or both of the forward flange 58 and aft flange 60. The slots 80 extend widthwise across the flanges 58, 60 a distance adequate to provide a cooling air path around the edge surface 42 of the respective liner segment 24. In the embodiment shown in FIGS. 5 and 6, the slots 80 extend the entire width 68 of each flange 58, 60.

Figure 7:
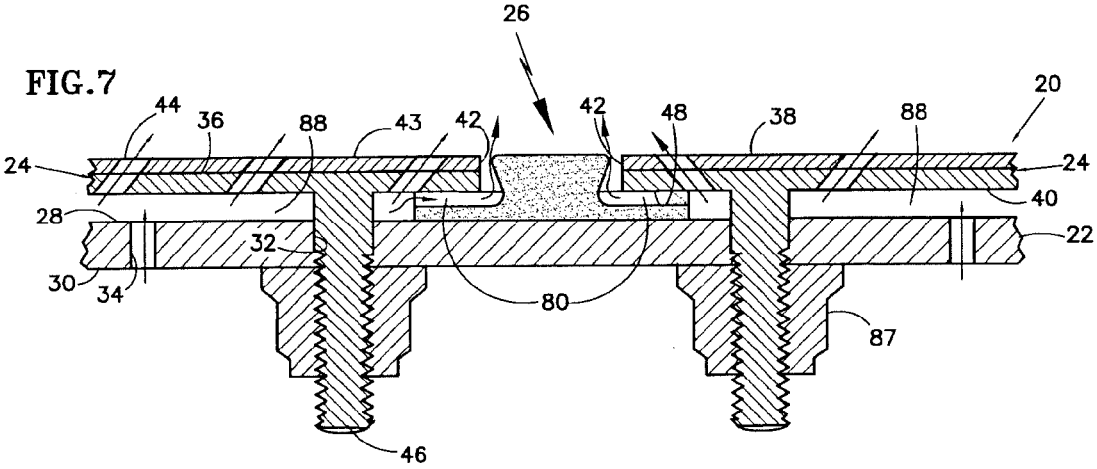
FIG. 7 is a cross-sectional diagrammatic illustration of a combustor that includes liner segments and a seal member embodiment.
Figure 8:
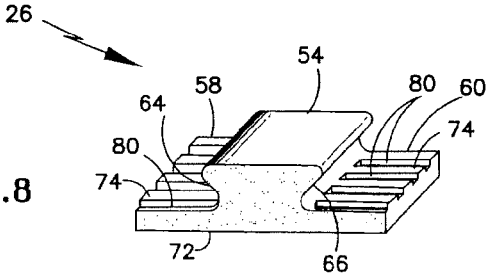
FIG. 8 is a perspective diagrammatic illustration of the seal member shown in FIG. 7.
Figure 9:
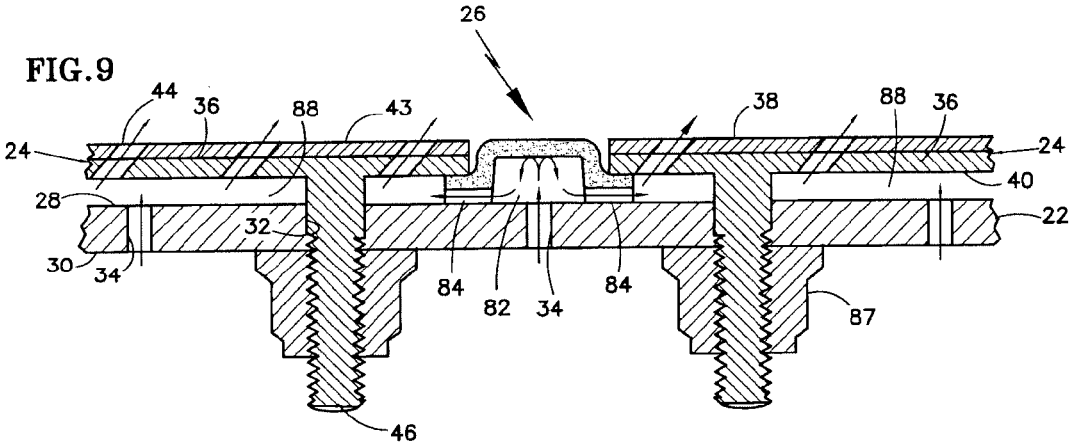
FIG. 9 is a cross-sectional diagrammatic illustration of a combustor that includes liner segments and a seal member embodiment.
Figure 10:
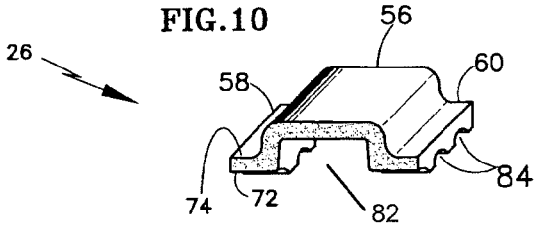
FIG. 10 is a perspective diagrammatic illustration of the seal member shown in FIG. 9.
Figure 11:
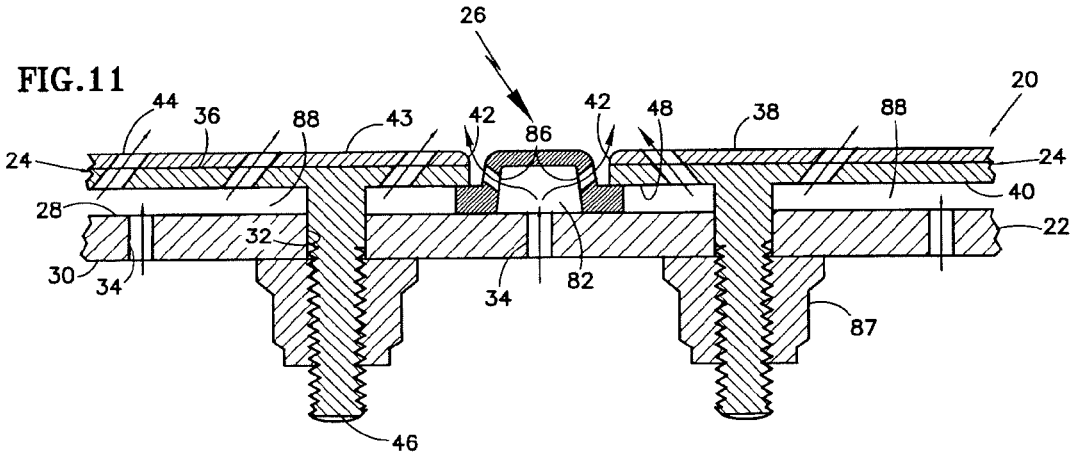
FIG. 11 is a cross-sectional diagrammatic illustration of a combustor that includes liner segments and a seal member embodiment.
Figure 12:
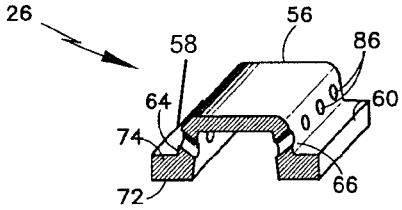
FIG. 12 is a perspective diagrammatic illustration of the seal member shown in FIG. 11.

In the embodiment shown in FIGS. 7 and 8, the seal member side surfaces 64, 66 each have a profile that mates with the profile of the edge surfaces 42 of the liner segments 24; e.g., each side surface 64, 66 has a relief cavity disposed therein which is shaped to receive a portion of a liner segment edge surface 42. In addition, the embodiment shown in FIGS. 7 and 8 can include cooling air slots 80 similar to those shown in FIGS. 5 and 6. The combination of the mating geometry and the cooling air slots 80 creates cooling air paths that surround a portion of the respective liner segment edge surface 42.

In the embodiment shown in FIGS. 9-12, the seal member 26 is cooled by impingement air passing through the shell 22. The seal member 26 includes a channel 82 disposed in the base surface 52, aligned with the center section 56. The channel 82 extends lengthwise along the seal member 26 and provides a passage for cooling air. As will be described below, impingement cooling holes 34 disposed in the shell 22 provide a source of cooling air into the channel 82. In the embodiment shown in FIGS. 9 and 10, one or more cooling air slots 84 are disposed in the shell side surface 72 of one or both flanges 58, 60. The cooling air slots 84 extend completely across the flange(s) 58, 60 and allow cooling air within the channel 82 to exit the channel 82 via the slots 84. In the embodiment shown in FIGS. 11 and 12, one or more cooling air holes 86 are disposed in one or both of the forward side surface 64 and the aft side surface 66 of the center section 56. The cooling air holes 86 can be oriented to provide desirable cooling in the region of the seal member side surface 64, 66 and liner segment edge surface 42; e.g., the cooling air holes 86 can be oriented to impinge cooling air on the respective liner segment edge surface 42, or to create film cooling across the edge surface 42, or some combination thereof.

In the assembly of the combustor 20, seal members 26 are disposed relative to adjacent liner segments 24 such that each seal member flange 58, 60 is disposed between the shell 22 and a seal shoulder 48 of an adjacent liner segment 24, and the center section 56 of each seal member 26 is disposed between the edge surfaces 42 of adjacent liner segments 24. The mounting studs 46 of each liner segment 24 extend through mounting holes 32 in the shell 22 and locking nuts 87 are screwed onto the studs 46 to hold the liner segment 24 on the interior surface 28 of the shell 22.

Each seal member 26 is located and attached relative to the shell 22 by the liner segments 24 on each side of the seal member 26. The seal member 26 may be positionally fixed by the liner segments 24 being secured to the shell 22 such that the seal member flanges 58, 60 are clamped between the liner segment seal shoulders 48 and the shell 22. Alternatively, the seal members 26 can be located and attached to the shell 22, with some ability for relative movement, by the center section 56 extending between the edge surfaces 42 of the adjacent liner segments 24, and the flanges 58, 60 extending between the shell 22 and the liner segment seal shoulders 48. The location and attachment of the seal members 26 could also be some combination of seal member 26 geometry and clamping.

In the operation of a combustor 20 utilizing the seal member 26 embodiment shown in FIGS. 1-3, the seal member 26 prevents the flow of impingement cooling air between adjacent liner segments 24. The center section 56 of the seal member 26 extends between the edge surfaces 42 of the adjacent liner segments 24, and substantially fills what would otherwise be a void between the two liner segments 24. As indicated above relative to the prior art, such voids can be subject to thermal hot spots. In those seal member 26 embodiments having a TBC 78 on one or more of the center section base surface 52 or the shell side surfaces 72 of the flanges 58, 60, the TBC 78 assists in impeding thermal energy transfer to the shell 22.

Regarding the seal member 26 embodiment shown in FIGS. 5 and 6, impingement cooling air enters the compartment 88 formed between the shell 22 and liner segment 24. The cooling air impinges on the back surface of the liner segment 24. A portion of the cooling air subsequently exits the compartment 88 through the film coolant holes 44 disposed in the liner segment panel 36. Another portion of the cooling air exits the compartment 88 through the slots 80 disposed in the shell side surface 72 of each seal member flange 58, 60. The cooling air passing through the slots 80 cools the seal shoulders 48 and edge surfaces 42 of the respective liner segment 24.

Regarding the seal member 26 embodiment shown in FIGS. 7 and 8, the impingement cooling air disposed within the compartment 88 formed between the shell 22 and the liner segment 24 exits the compartment 88 in a manner similar to that described above relating to the embodiment of FIGS. 5 and 6. The mating seal member side surfaces 64, 66 and liner segment edge surfaces 42 enhance the cooling by increasing the amount of edge surface 42 covered by the cooling air.

Regarding the seal member 26 embodiments shown in FIGS. 9-12, cooling air travels through impingement cooling holes 34 disposed in the shell 22, which holes are aligned with the channel 82 disposed within the seal member 26. The cooling air impinges on and thereby cools the center section 56. In the embodiment shown in FIGS. 9 and 10, the cooling air subsequently exits the channel 82 through the slots 84 disposed in the shell side surface 72 of one or both flanges 58, 60 and cools the flanges 58, 60 and consequently the liner segment seal shoulders 48. Once the cooling air has exited the slots 84, it is available for film cooling of the respective liner segment 24. In the embodiment shown in FIGS. 11 and 12, the cooling air exits the channel 82 through the cooling holes 86 disposed in one or both of the forward side surface 64 and the aft side surface 66 of the center section 56. The cooling air holes 86 can be oriented in a variety of ways to create different cooling conditions; e.g., the cooling air holes 86 can be oriented to cause cooling air to impinge on the respective liner segment edge surface 42, or to create film cooling across the edge surface 42, or some combination thereof.

Although this invention has been shown and described with respect to the detailed embodiments thereof, it will be understood by those skilled in the art that various changes in form and detail thereof may be made without departing from the spirit and scope of the claimed invention.

What is claimed is:

1. A combustor liner segment seal member, comprising:

a center section having a base surface, a gas path surface exposed to a gas path of a combustor, a forward side surface, and an aft side surface;

a forward flange extending outwardly from the forward side surface, the forward flange having a width, a height, a shell side surface, and a liner side surface; and an aft flange extending outwardly from the aft side surface, the aft flange having a width, a height, a shell side surface, and a liner side surface;

wherein a forward combustor liner segment is disposed on the liner side surface of the forward flange and an aft combustor liner segment is disposed on the liner side surface of the aft flange.

2. The seal member of claim 1, wherein the center section has a height that is greater than the height of the forward flange and the height of the aft flange.

3. The seal member of claim 2, wherein a thermal barrier coating is attached to at least one surface of the seal member.

4. The seal member of claim 1, wherein the seal member is configured to form a circumferentially extending seal.

5. The seal member of claim 1, wherein the base surface of the seal member is planar.

6. The seal member of claim 1, further comprising one or more cooling air slots disposed in the liner side surface of at least one of the forward flange and the aft flange.

7. The seal member of claim 6, wherein the cooling air slots extend across substantially all of the width of the flange in which the slots are disposed.

8. The seal member of claim 7, wherein the seal member is configured to form a piece of a circumferentially extending seal.

9. A combustor for a gas turbine engine, comprising:

a support shell of the combustor, the support shell having an interior surface;

a forward liner segment attached to the interior surface of the support shell, the forward liner segment having an edge surface extending between a face surface and a back surface, and a seal shoulder portion;

an aft liner segment attached to the interior surface of the support shell, the aft liner segment having an edge surface extending between a face surface and a back surface, and a seal shoulder portion;

wherein the forward liner segment and the aft liner segment are separated from one another by a gap; and a seal member disposed within the gap, the seal member having a center section, a forward flange, and an aft flange;

wherein the seal shoulder portion of the forward flange is disposed on the forward flange of the seal member and the seal shoulder portion of the aft flange is disposed on the aft flange of the seal member.

10. The combustor of claim 9, wherein the center section of the seal member has a height that is greater than a height of the forward flange and a height of the aft flange.

11. The combustor of claim 9, wherein a thermal barrier coating is attached to at least a surface of the seal member.

12. The combustor of claim 9, wherein the seal member is configured to form a circumferentially extending seal.

13. The combustor of claim 9, wherein the seal member includes one or more cooling air slots disposed in a liner side surface of at least one of the forward flange and the aft flange, which one or more cooling air slots provide a cooling air passage between the respective flange and the seal shoulder.

14. The combustor of claim 13, wherein one or more cooling air slots extend across substantially all of the width of the flange in which one or more slots are disposed.

15. The combustor of claim 9, wherein the seal member center section has side surfaces that have a profile that mates with a profile of the edge surfaces of the forward and aft liner segments.

* * * * *